US006758356B1

(12) United States Patent
Zuehlke et al.

(10) Patent No.: US 6,758,356 B1
(45) **Date of Patent: *Jul. 6, 2004**

(54) LIFTCRANE WITH SYNCHRONOUS ROPE OPERATION

(75) Inventors: Arthur G. Zuehlke, Manitowoc, WI (US); David J. Pech, Manitowoc, WI (US)

(73) Assignee: Manitowoc Crane Companies, Inc., Reno, NV (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 492 days.

(21) Appl. No.: 08/748,986

(22) Filed: Nov. 14, 1996

Related U.S. Application Data

(60) Division of application No. 08/210,988, filed on Mar. 18, 1994, now Pat. No. 5,579,931, which is a continuation-in-part of application No. 07/566,751, filed on Aug. 13, 1990, now Pat. No. 5,297,019, which is a continuation-in-part of application No. 07/418,879, filed on Oct. 10, 1989, now Pat. No. 5,189,605.

(51) Int. Cl.[7] ..... B66D 1/26
(52) U.S. Cl. ..... 212/270
(58) Field of Search ..... 254/285, 267, 254/269, 270, 281; 212/153, 159, 190, 191, 274, 276, 284, 281, 270

(56) References Cited

U.S. PATENT DOCUMENTS

| | | | |
|---|---|---|---|
| 2,030,529 A | 2/1936 | Nash | |
| 3,265,360 A | 8/1966 | Tax | |

FOREIGN PATENT DOCUMENTS

| | | | | |
|---|---|---|---|---|
| DE | 3115471 A1 | | 10/1982 | |
| DE | 3404505 | * | 9/1985 | ..... 254/415 |
| DE | 3611553 C1 | | 7/1987 | |
| DE | 0364994 A1 | | 10/1989 | |
| EP | 0 076 485 A1 | | 4/1983 | |
| EP | 0 253 657 A 2 | | 1/1988 | |
| FR | 7200064 | | 1/1972 | |
| GB | 2187160 | * | 9/1987 | |
| GB | 2234728 | | 2/1991 | |
| JP | 40213079 | | 5/1990 | |
| SU | 161107 | | 3/1964 | |
| SU | 943188 | * | 7/1982 | ..... 212/276 |

OTHER PUBLICATIONS

Liebherr "Technical Data Cable Excavator", Oct. 1986.

Liebherr "Technical Description", (HS 840, HS 850, HS 870) Apr. 1985.

*Primary Examiner*—Thomas J. Brahan
(74) *Attorney, Agent, or Firm*—Steven P. Shurtz; Brinks Hofer Gilson & Lione

(57) ABSTRACT

An improved method and system for a liftcrane in which a load is lifted through the combined action of first and second hoist drums. The method and system use a first rope wound on one hoist drum and a second rope wound on the second hoist drum. The ends of the ropes opposite the hoist drums are linked together to transmit tension between them. The load is coupled to the ropes. If the take up speed of one of the ropes exceeds the take up speed of the other, the linked ends of the ropes will shift. This condition is detected and the operation of at least one of the first and second hoist drums is modified to bring the take up rates into balance. This system is advantageously used with a hoist block sheave arrangement. This system can also be used with a single rope in which each of the ends of the single rope are wound on a separate one of the hoist drums and the load is coupled to the middle of the rope.

(List continued on next page.)

20 Claims, 11 Drawing Sheets

U.S. PATENT DOCUMENTS 3,335,568 A 8/1967 Van De Hey
3,531,088 A 9/1970 Krachnewski
3,575,300 A * 4/1971 Durand ..... 212/63
3,620,504 A 11/1971 Morrison
3,661,279 A * 5/1972 Macrander ..... 214/15 R
3,734,564 A * 5/1973 McKay et al. ..... 299/9
3,743,107 A * 7/1973 Verschoof ..... 212/125
3,759,489 A * 9/1973 Jones ..... 254/173 R
3,847,251 A * 11/1974 Maltby et al. ..... 187/29 R
3,851,766 A 12/1974 Gill et al.
4,144,974 A 3/1979 Longthorpe
4,178,591 A 12/1979 Geppert
4,180,171 A * 12/1979 Cunningham et al. ..... 212/61
4,185,280 A 1/1980 Wilhelm
4,227,676 A 10/1980 Vaillant et al.
4,261,119 A * 4/1981 Kubo et al. ..... 37/195
4,268,013 A 5/1981 Kahn
4,370,713 A * 1/1983 McCoy et al. ..... 364/424
4,451,893 A 5/1984 Izumi et al.
4,489,551 A 12/1984 Watanabe et al.
4,506,791 A 3/1985 Brosigke
4,510,750 A 4/1985 Izumi et al.
4,514,796 A 4/1985 Saulters et al.
4,532,595 A 7/1985 Wilhelm
4,665,696 A * 5/1987 Rosman ..... 60/414
4,782,662 A 11/1988 Reeves et al.
4,815,614 A 3/1989 Putkonen et al.
4,905,848 A 3/1990 Skjonberg
4,953,723 A 9/1990 Saotome et al.
4,969,562 A 11/1990 Saotome
4,995,472 A 2/1991 Hayashi et al.
5,029,067 A 7/1991 Nishida
5,034,892 A 7/1991 Saotome
5,160,056 A 11/1992 Yoshimatsu et al.
5,189,605 A 2/1993 Zuehlke et al.
5,297,019 A 3/1994 Zuehlke
5,361,565 A * 11/1994 Bayer ..... 254/292
5,579,931 A * 12/1996 Zuehlke et al. ..... 212/276

* cited by examiner

LIFTCRANE WITH SYNCHRONOUS ROPE OPERATION

REFERENCE TO RELATED APPLICATION

This application is a division of application No. 08/210,988, filed Mar. 18, 1994, now U.S. Pat. No. 5,579,931, the entire disclosure of which is incorporated herein by reference.

BACKGROUND OF THE INVENTION

The present invention relates to liftcranes and in particular to heavy duty liftcranes that use a hoist block sheave arrangement.

Liftcranes are used for a variety of lifting tasks. When liftcranes are used for lifting very heavy loads one arrangement that has been devised is to employ a hoist block sheave arrangement. A hoist block sheave arrangement uses upper and lower block halves suspended from the end of the liftcrane boom. Each of the block halves includes a plurality of corresponding sheaves. The lower block half may also include a hook or other similar device to which the load can be attached. The upper and lower block halves are connected by hoist rope or cable that is reeved through the corresponding sheaves of each block half.

The purpose of the hoist block sheave arrangement is twofold. First, the multiple sheaves connecting the upper and lower block halves provide a mechanical advantage as an arrangement of multiple pulleys. Secondly, lifting can be accomplished using two drum hoists instead of one. This latter advantage can be obtained because a single length of rope is reeved through the sheaves of the hoist block and each end of the rope is wound around a separate hoist drum on the liftcrane. Thus, the load can be lifted using not only the mechanical advantage of the multiple pulleys, but also with the lifting power of two hoist drums. Examples of liftcranes that use hoist block sheave arrangements include Models 4000, 4100, and 36 ft. platform Ringers manufactured by the Manitowoc Engineering Co. of Manitowoc, Wisconsin. Some of these liftcranes can lift loads of 800 to 1400 tons or more.

When a hoist block sheave arrangement is used in the manner as explained above, a relatively great length of rope is required, e.g. 4500 feet. This is because a single rope is reeved through the multiple hoist block sheaves and both ends of the rope are run all the way back to the two hoist drums. Using a single rope of this great length can present disadvantages. For example, it is cumbersome to dismantle the hoist block sheave arrangement in case the liftcrane has to be moved. Also, since only a single rope of great length is used, neither the front nor the rear drum is typically large enough to hold the entire length of rope. Thus, the rope must be removed entirely from the liftcrane and wound onto a separate spool. Then, in order to use the liftcrane again, the rope must be wound off the spool and reeved through the hook block sheaves and boom and around both the front and rear drums. Thus, additional time and effort must be expended in order to take advantage of the hoist block sheave arrangement.

SUMMARY OF THE INVENTION

According to an aspect of the present invention, there is provided an improved method and system for a liftcrane in which a load is lifted through the combined action of first and second hoist drums. The method and system use two ropes. A first rope-is wound on one hoist drum and a second rope wound on the second hoist drum. The ropes extend over a boom and the ends of the ropes opposite the hoist drums are linked together so that tension can be transmitted between them. The load is lifted by a hook carried by the linked ropes. If the take up speed of one of the ropes exceeds the take up speed of the other rope, the linked ends of the ropes will shift. This condition is detected and the operation of at least one of the first and second hoist drums is modified to adjust the take up rates of the two ropes into balance. This system is advantageously used with a hoist block sheave arrangement.

Figure 14:
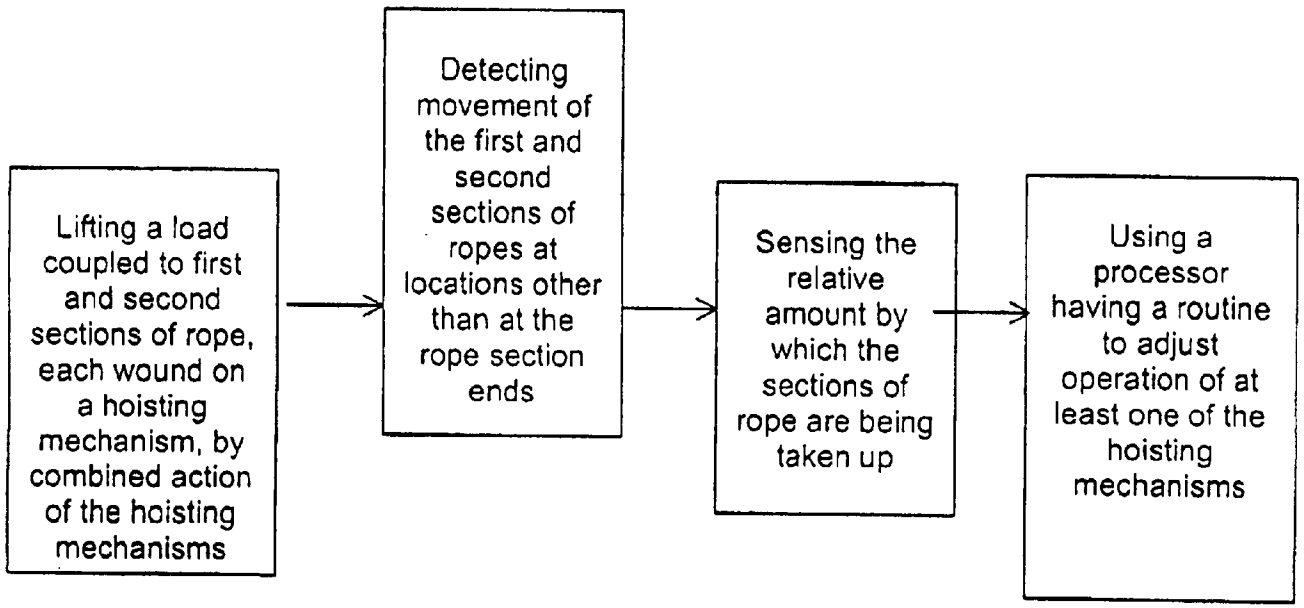
FIG. 14 is a flow chart showing the steps of a method of operating the crane of the present invention.

It is also noted that although in a preferred embodiment the sensor is mechanically attached to a link connecting the two ropes, it would also be possible to detect movement of the two ropes relative to each other by non-mechanical means. For example, shifting of the link and/or the ropes could be detected by an optical sensor, a magnetic sensor, or other types of sensors that employ other than mechanical connections, e.g. Hall effect, capacitive, etc. This detection could be performed at locations other than at the rope ends, as represented by FIG. 14.

DESCRIPTION OF PRESENTLY PREFERRED EMBODIMENTS

Figures 1, 2:
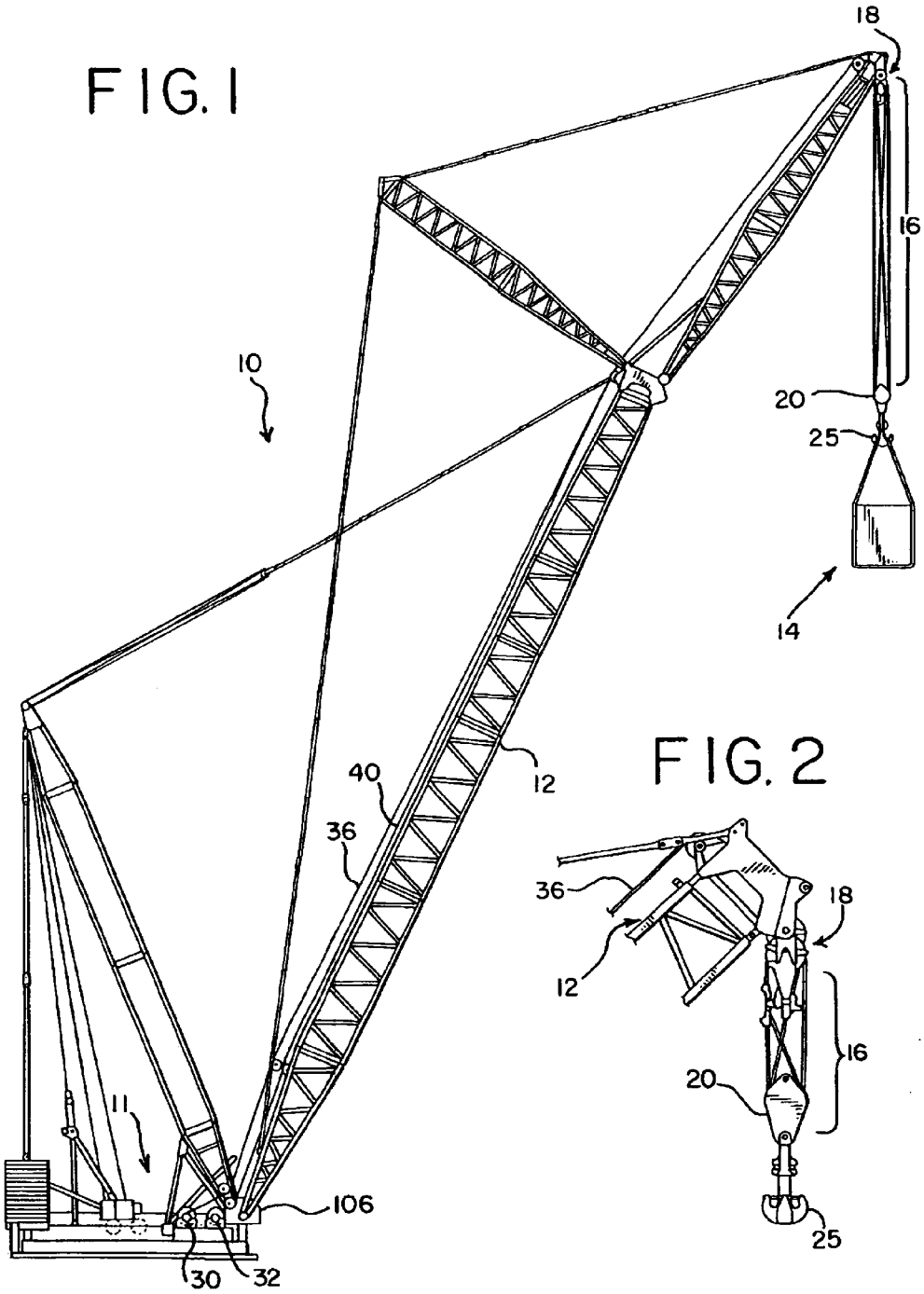
FIG. 1 is a side view of a liftcrane incorporating a first embodiment of the present invention.
FIG. 2 is an expanded view of the top end of the boom of the liftcrane shown in FIG. 1.

FIG. 1 depicts a heavy duty liftcrane 10 having an upper works 11 to which is attached a boom 12 that is used to lift a heavy-load 14. The liftcrane 10 also includes an engine to deliver power to the various mechanical systems of the liftcrane and a hydraulic system including actuators and pumps. For additional details regarding these aspects of the liftcrane, reference is made to the related applications Ser. Nos. 07/566,751 and 07/418,879, referred to above.

Figure 3:
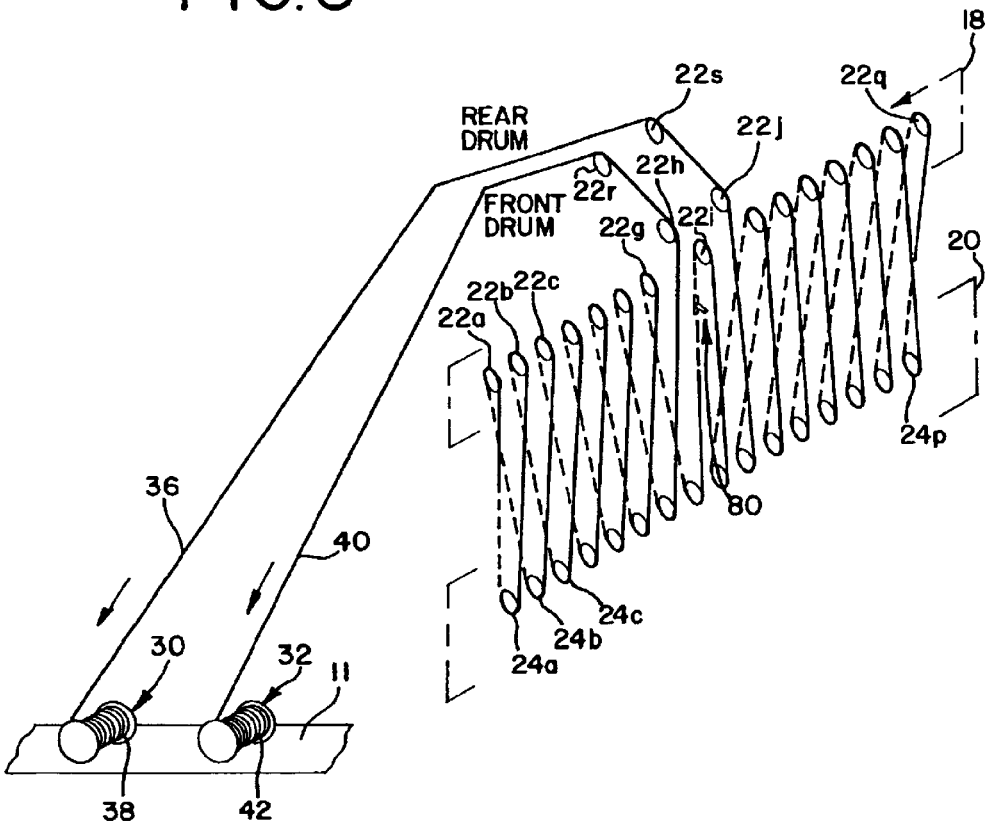
FIG. 3 is a diagram illustrating the reeving arrangement of the liftcrane shown in FIG. 1.
Figure 4:
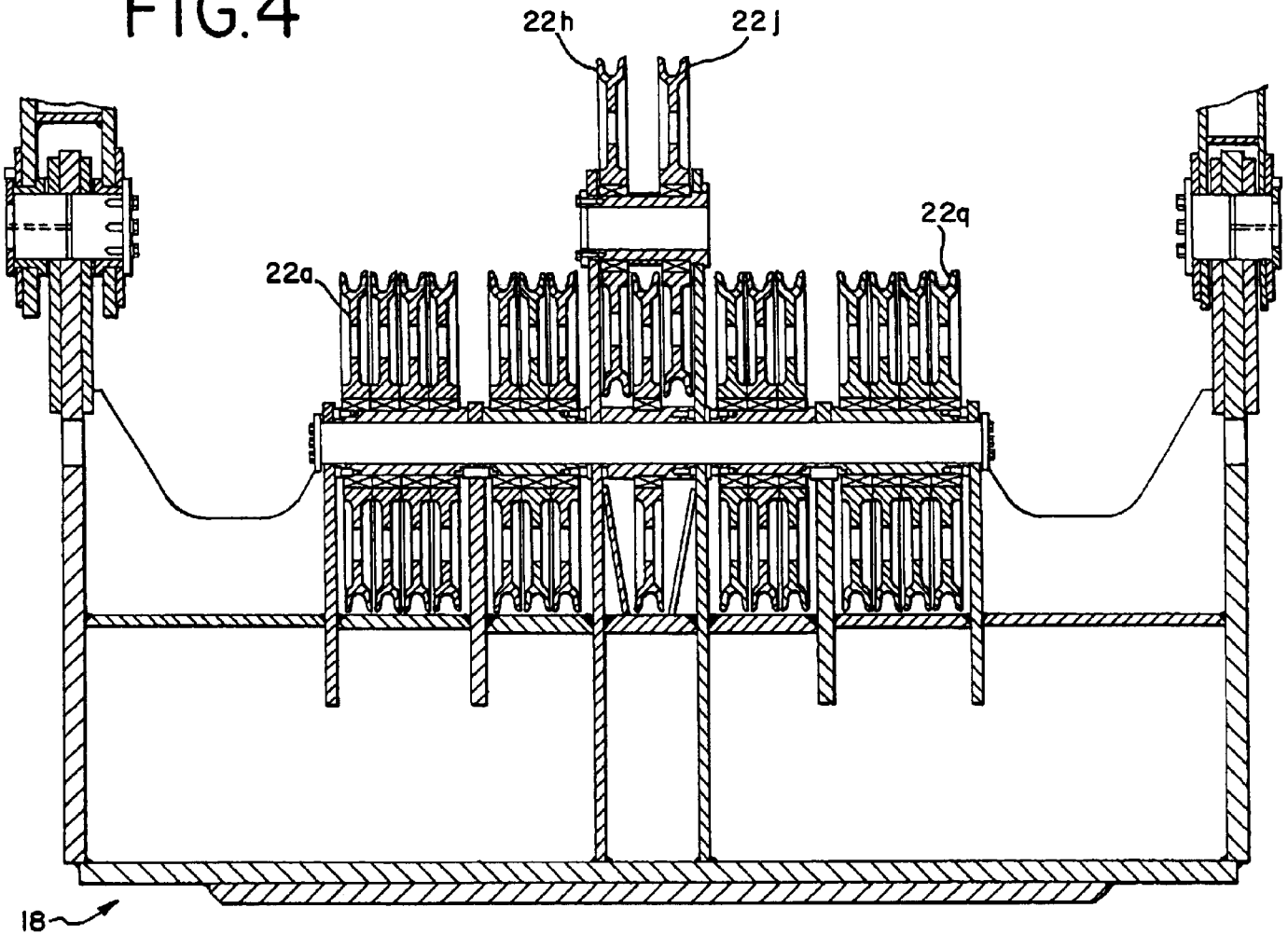
FIG. 4 is a sectional view of the upper half of the hoist block sheave arrangement shown in the embodiment of FIG. 1.

With very heavy loads, a hook block sheave arrangement 16 is used. Referring to FIG. 2, the hook block sheave arrangement 16 includes an upper block half 18 and a lower block half 20. As illustrated in the diagram of FIG. 3 and in FIGS. 4–7, located on the upper block half 18 are a plurality of sheaves 22 (designated,22*a*–22*s*) and located on the lower block half 20 are a plurality of sheaves 24 (designated 24*a*–24*p*) which correspond to the sheaves 22 on the upper block half 18. A hook 25 is connected to the lower block half 20.

Lifting of the load 14 with the hook block sheave arrangement 16 is accomplished with two hoist drums. Referring to FIGS. 1 and 3, located on the upperworks body 11 of the liftcrane are a first or rear hoist drum 30 and a second or front hoist drum 32.

Figure 5:
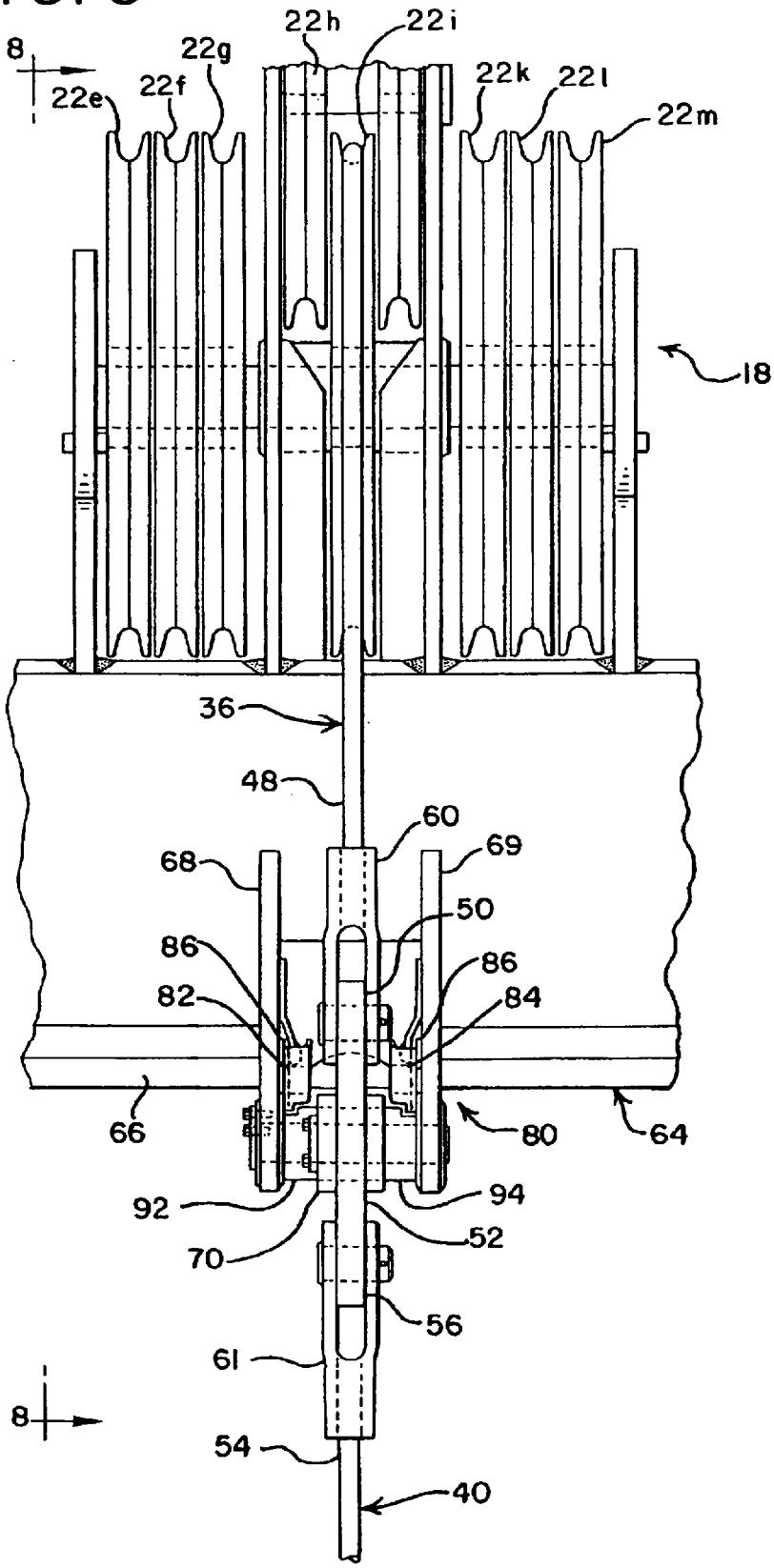
FIG. 5 is a front view of a portion of the upper half of the hoist block sheave arrangement shown in the embodiment of FIG. 1.
Figure 7:
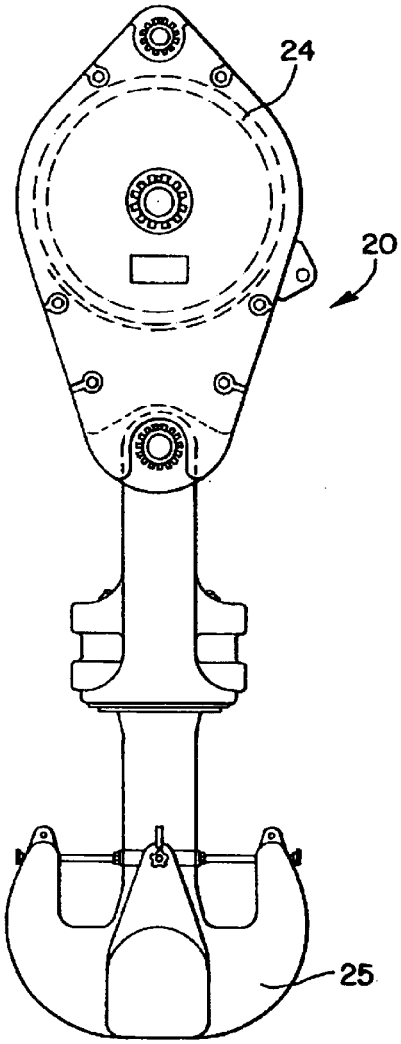
FIG. 7 is a side view of the lower half of the hoist block sheave arrangement shown in the embodiment of FIG. 1.
Figure 6:
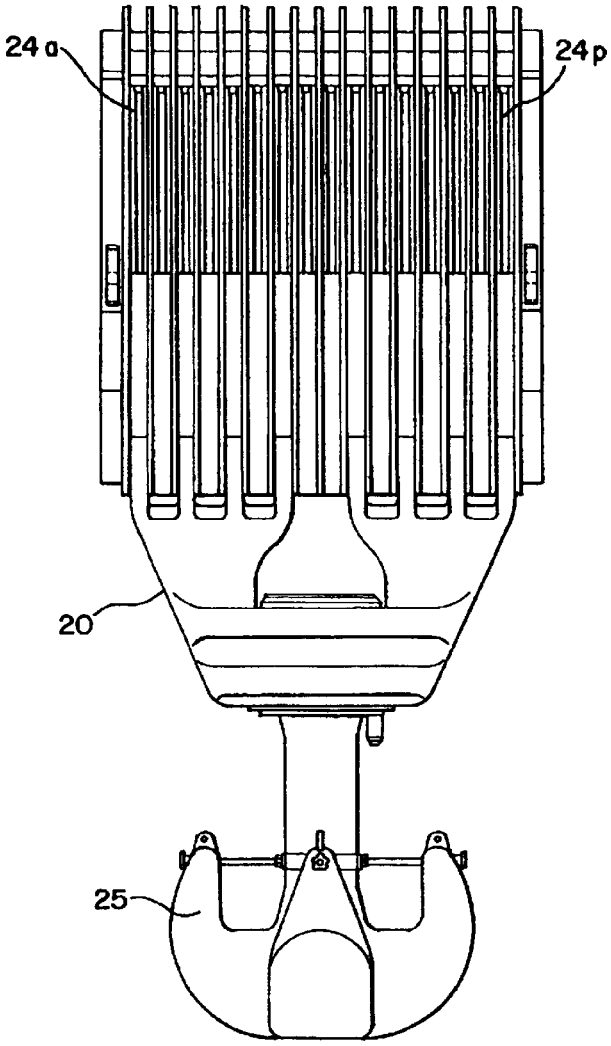
FIG. 6 is a front view of the lower half of the hoist block sheave arrangement shown in the embodiment of FIG. 1.
Figure 8:
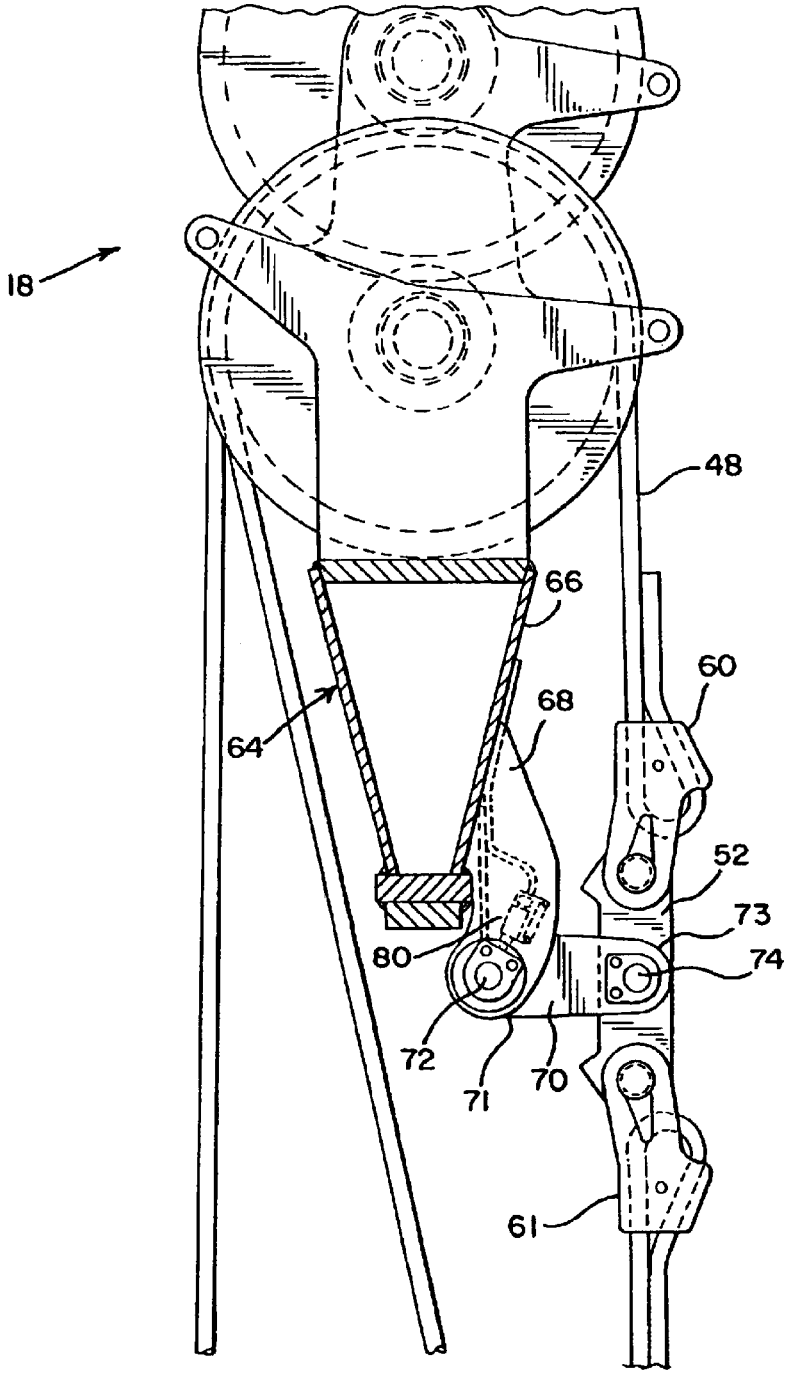
FIG. 8 is a sectional view taken along lines 8—8' of FIG. 5.

According to a preferred aspect of the invention, two separate ropes, or load lines, are used. A first rope or load line 36 is associated with the first hoist drum 30 and includes a first end 38 wound around the first hoist drum 30. A second rope or load line 40 is associated with the second hoist drum 32 and has a first end 42 wound around the second hoist drum 32. The first and second ropes 36 and 40 extend from the first and second hoist drums 30 and 32 up along the boom 12. In this embodiment, the first and second ropes 36 and 40 are reeved through the sheave arrangement 16 through the sheaves 22 and 24 of the upper and lower block halves 18 and 20. As shown in FIGS. 5 and 8, a second end 48 of the first rope 36 is connected to one side 50 of a link 52 and a second end 54 of the second rope 40 is connected to a second side 56 of the link 52. The link 52 is positioned in the hook block sheave arrangement between the upper and lower rows of sheaves. The second ends 48 and 54 of the two ropes are connected to the link 52 by an appropriate means, such as anchoring devices 60 and 61. It is preferable that the second ends of the ropes can be readily disconnected from the link as necessary.

Even though two separate pieces of rope are used, they function as a single piece of rope since they are connected to each other via the link 52. Thus, the link permits transfer of tension from one rope to the other so that the tension on both ropes is substantially equal. This permits the load to be lifted through the combined action of both hoist drums and permits a means for sensing the relative movement of the ropes if the tension is not equal, as explained below.

A sensor for sensing the relative movement of the ropes is connected to one of the block halves. Referring to FIGS. 5 and 8, in a preferred embodiment this sensor is connected to the upper block half 18 and specifically to an upper block frame 64 of the upper block half 18. The upper block frame 64 includes a base portion 66 and first and second arm portions 68 and 69 that are connected directly to the base portion 66 and which extend into proximity with the link 52. An actuator lever 70 has one end 71 located between the first and second arm portions 68 and 69 and pivotally connected thereto at 72. The other end 73 of the actuator lever 70 is pivotally connected to the link 52 at 74.

A sensor assembly 80 is mounted on the upper block frame 64. As shown in FIGS. 5 and 8, the sensor assembly 80 includes a first limit switch 82 and a second limit switch 84. Each of these limit switches is mounted on one of the arm portions, for example, the first limit switch 82 is mounted on the first arm portion 68 and the second limit switch 82 is mounted on the second arm portion 69. Mounting of the limit switches onto the arm portions may be facilitated by use of mounting pads 85 and 86. In a preferred embodiment, the mounting pads are clamped onto the arm portions 68 and 69 and the limit switches 82 and 84 are attached by bolts or other fasteners onto the pads. Other suitable means for mounting the limits switches may also be used.

Each of the limit switches includes a body portion and a roller pin portion. Referring to FIG. 8, the first limit switch 82 has a body portion 88 and a roller pin portion 90. The second limit switch 84 is similar or identical to the first limit switch. The roller pin portion 90 is biased to extend outward from the limit switch body portion 88. The roller pin portion 90 is slidable, upon application of sufficient force thereto, to move from an extended position to a retracted position. In the absence of a sufficient force applied thereto, the roller pin portion 90 assumes its fully extended position due to the biasing of the limit switch. The limit switches 82 and 84 output a signal indicative of the roller pin position, i.e. extended or retracted. The limit switches may do this by any suitable means such as for example outputting a high voltage signal indicative of one position and a low voltage signal indicative of the other position. Alternatively, the limit switches may output pulses or other signals indicative of a transition from one position, or state, to the other position or state. In a preferred embodiment, the limit switch used is a model 35ZS1 available from the Micro Switch Company.

Connected to the actuator arm 70 are a first cam 92 and a second cam 94. The first and second cams 92 and 94 may be formed of a single piece of metal with the actuator lever arm 70 or alternatively they may be formed of separate pieces and connected to it. First and second cams 92 and 94 are located between the arm portions 68 and 69 of the upper block frame 64. First and second cams 92 and 94 have their axes coincident with the axis of the pivotal connection 72 between the actuator arm 70 and the upper block frame 64. The first and second cams are connected to the actuator arm in a manner such that they move with the actuator arm 70 as it pivots about axis 72.

Figure 9:
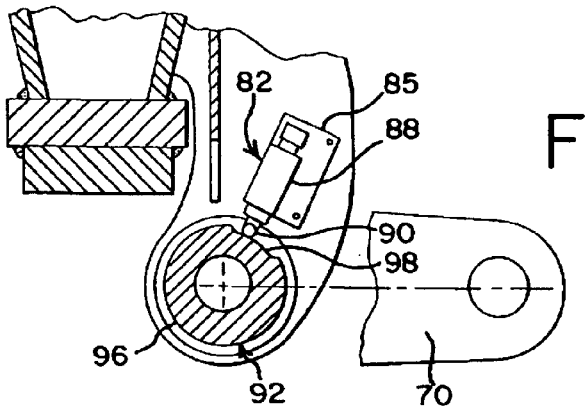
FIG. 9 is a sectional view showing a portion of FIG. 8.

First and second cams 92 and 94 have perimeter edges comprised of two sections. Referring again to FIG. 9, in a first cam perimeter section 96, which is approximately 314 degrees of the entire cam perimeter, the cam radius is of a first dimension and in a second cam perimeter section 98, which is the remaining approximately 46 degrees, the cam radius is of a second dimension which is less than the first dimension. In FIG. 9, the first limit switch 82 is shown with the actuator arm 70 in an approximately horizontal position. The first limit switch 82 is mounted on the arm portion 68 of the upper block frame 64 so that the roller pin 90 of the first limit switch 82 bears on the perimeter of the first cam 92. In the position shown in FIG. 9, the roller pin 90 bears on the second perimeter section 98 of the cam 92. In this position, the roller pin 90 of the limit switch 82 is in its extended, or biased outward, position.

Figure 10:
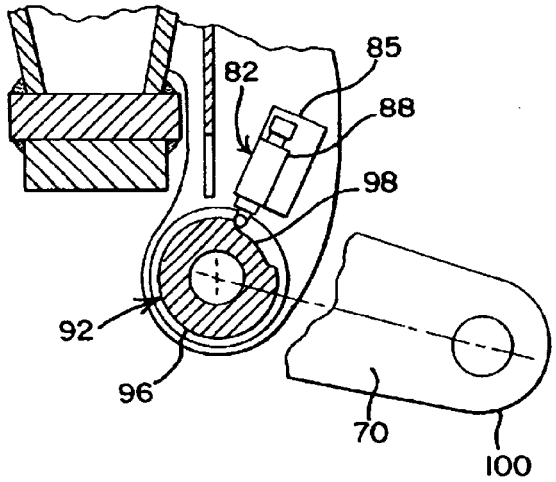
FIG. 10 is a sectional view similar to FIG. 9 showing the actuator arm in a first position.

Referring to FIG. 10, the actuator arm 70 is shown in phantom in a first position 100 in which the actuator arm 70 is rotated clockwise 15 degrees from the horizontal position of FIG. 9. When the actuator arm 70 is in the position shown in FIG. 10, the cam 92 has been rotated to a position at which the roller pin 90 of the limit switch 82 no longer bears on the lower perimeter section 98 of the cam 92, but instead the roller pin 90 bears on the upper perimeter section 96 of the cam. When the roller pin 90 bears on the higher perimeter section 96 of the cam, the roller pin 90 is forced from its extended position to its retracted position. When the roller pin 90 of the limit switch is moved from its extended to its retracted positions, the limit switch outputs a signal indicative of the roller pin position change.

The second limit switch 84 is mounted on the second arm portion 69 in a similar way as the first limit switch and bears on the second cam member 94 similarly. It is noted that whereas the first limit switch 82 is mounted to indicate actuator arm movement outside the range of 31 degrees counterclockwise from horizontal and 15 degrees clockwise from horizontal, the second limit switch 84 is mounted to indicate actuator arm movement 15 degrees counterclockwise from horizontal and 31 degrees clockwise from horizontal.

The limit switches send an output to a programmable controller that includes a CPU. The operation of the hoist drums 30 and 32 is under operation of the CPU so that the sensor input can be readily accommodated. The operation of hoist drums under the control of a programmable controller is described in detail in the related applications Ser. Nos. 07/566,751 and 07/418,879.

Figure 12:
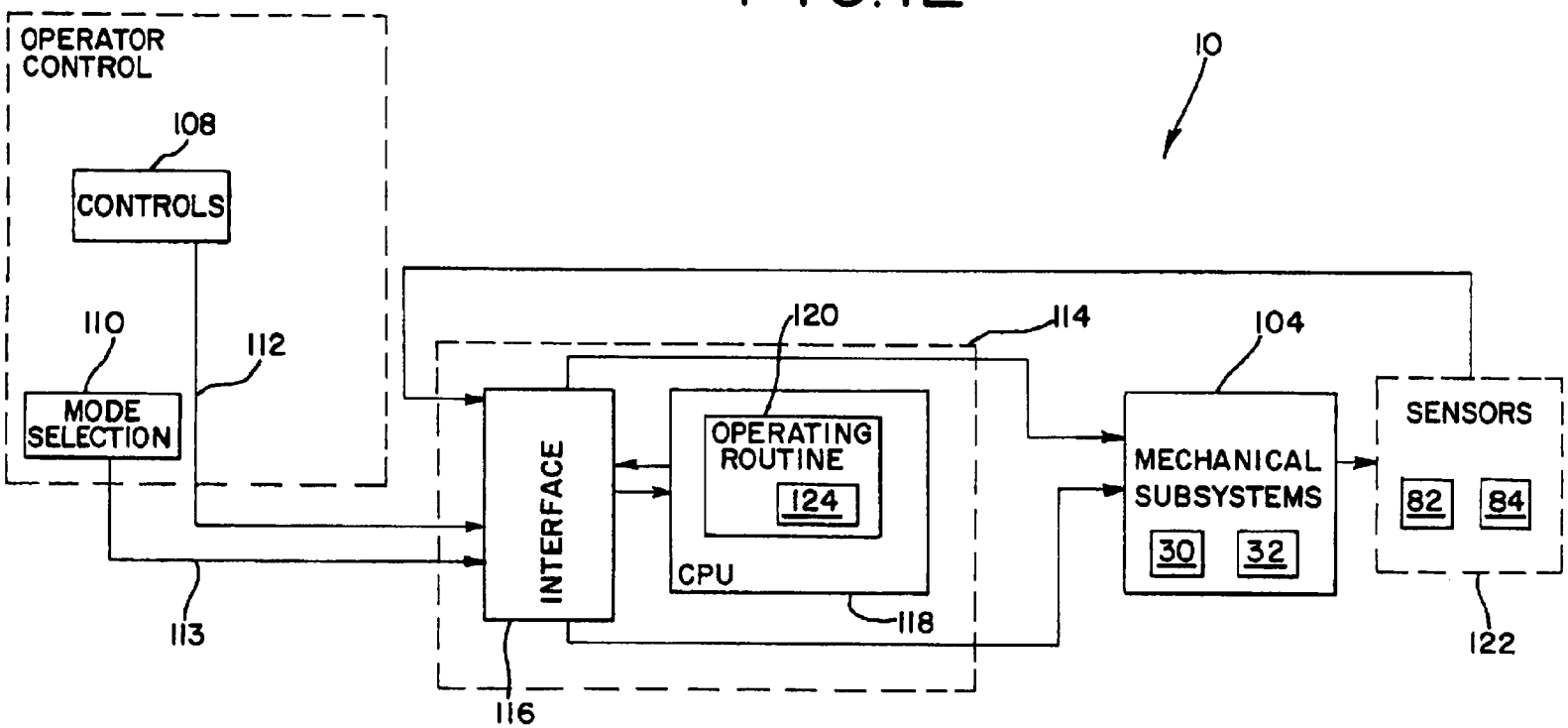
FIG. 12 is a block diagram of the control system for the liftcrane of FIG. 1.

Briefly, referring to FIG. 12, there is shown a block diagram of the control system for the embodiment of the liftcrane 10, described above. The various mechanical subsystems 104 of the liftcrane 10 include pumps and actuators for the front hoist 32, rear hoist 30, swing, boom, left and right crawlers, and so on. The mechanical subsystems 104 are under the control of an operator who occupies a position in the cab 106 (of FIG. 1) in the upper works 11 of the liftcrane. In the cab 106 are various operator controls 108 used for operation and control of the mechanical systems 104 of the liftcrane and which preferably include a mode selector 110 whose function is to tailor the operation of the liftcrane for specific type of activities. The outputs 112 and 113 of the operator controls 108 and the mode selector 110 are directed to a controller 114 and specifically to an interface 116 of the controller 114. The interface 116 in turn is connected to a CPU (central processing unit) 118. The controller 114 may be a unit such as the model IHC (Intelligent Hydraulic Controller) manufactured by Hydro Electronic Devices Corporation. The CPU 118 may be an Intel 8052. The CPU 118 runs a routine 120 which recognizes and interprets the commands from the operator (via the operator control 108) and outputs information back through the interface 116 directing the mechanical subsystems 104 to function in accordance with the operator's instructions. Movements, positions and other information about the mechanical subsystems 104 are monitored by sensors 122. These sensors 122 include the limit switches 82 and 84. Information from the sensors 122 is fed back to the interface 116 and in turn to the CPU 118. This information about the mechanical subsystems 104 provided by the sensors 122 is used by the routine 120 running on the CPU 118 to determine if the liftcrane is operating properly and responding to the operating commands.

Figure 13A:
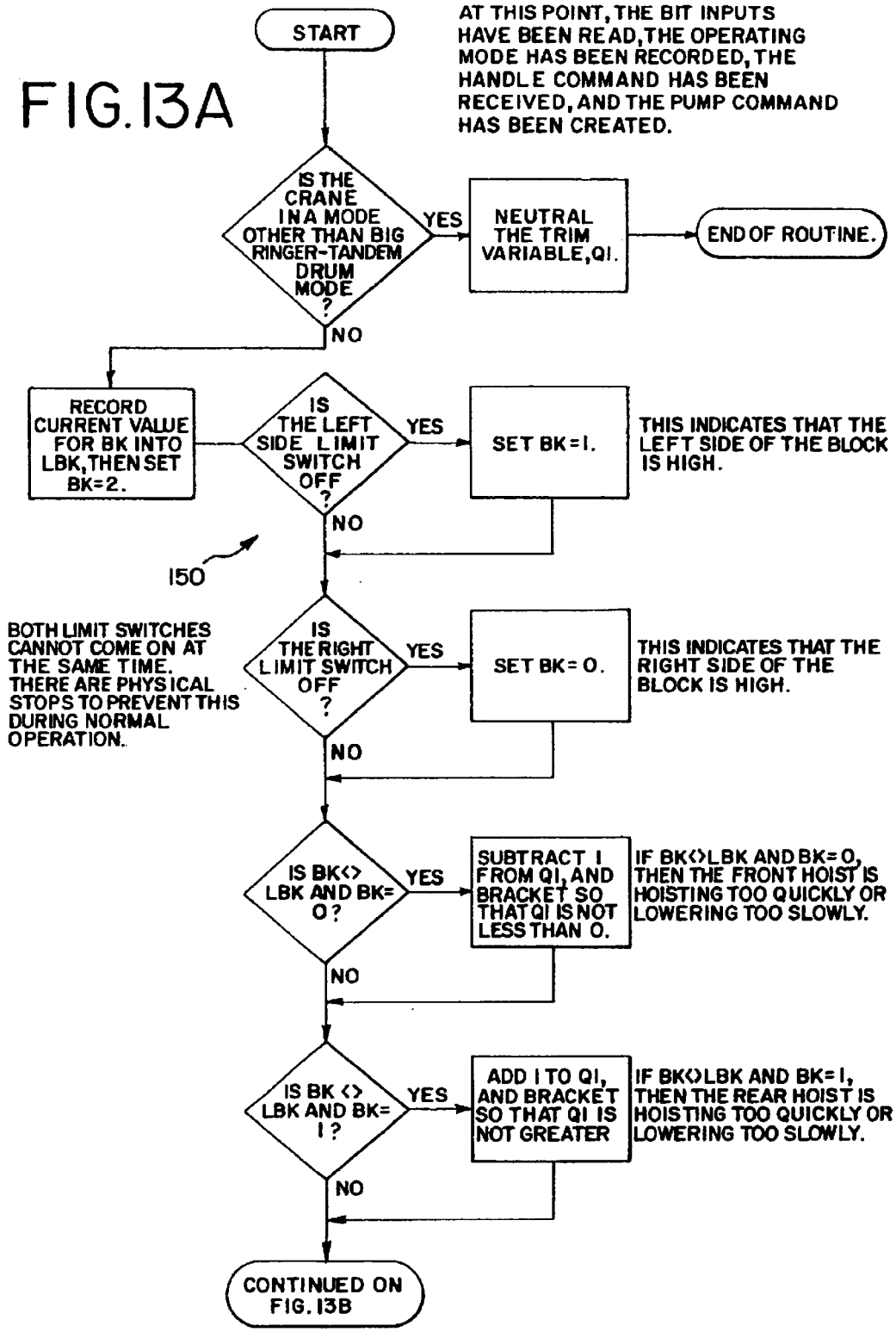
FIGS. 13A and 13B are a flow chart of the drum synchronization control routine shown in FIG. 12.
Figure 13B:
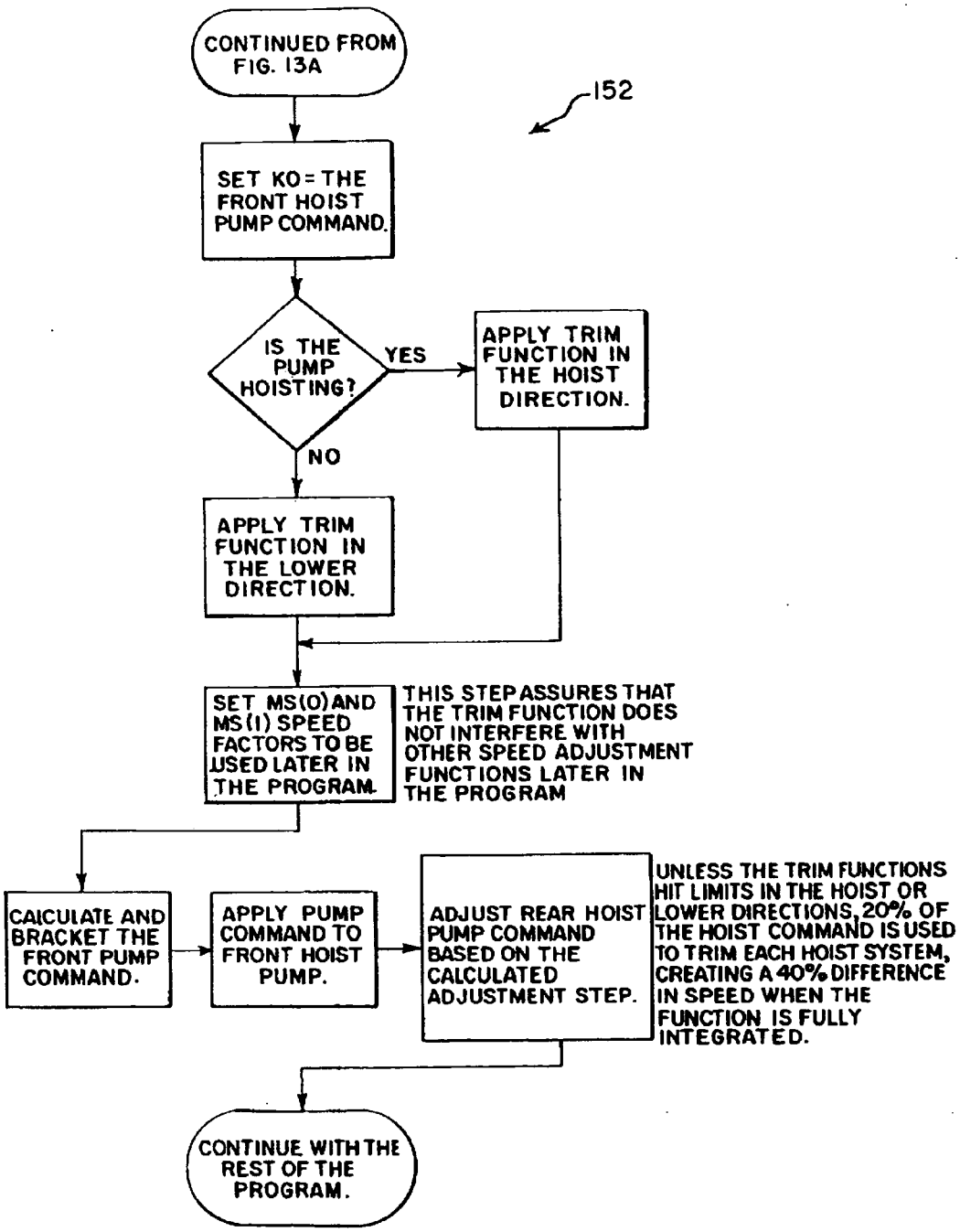

In accordance with a present embodiment, the controller 114 runs a drum synchronization routine 124. This drum synchronization routine 124 is preferably incorporated as a subroutine that is part of a general operating routine 120 that controls operation of the entire liftcrane 10 including all its mechanical systems and subsystems. The source code for the drum synchronization routine is included in Appendix A. FIGS. 13A and 13B are a flow chart of the hoist drum synchronization routine 124 that may be used to operate the first and second hoist drums in accordance with this embodiment of the present invention.

According to the present embodiment, the operator in the liftcrane cab operates the liftcrane controls to lift a load with the liftcrane with the hoist block sheave arrangement, as illustrated in FIG. 1. The load 14 has been attached to the hook 25 of the hoist block sheave arrangement 16. The operator manipulates the controls 108 to cause the first hoist drum 30 and the second hoist drum 32 to rotate to lift the load 14 through the combined action of both hoist drums. During the lifting, if the rope 40 from the second (front) hoist drum 32 runs slower than the rope 36 from the first (rear) hoist drum 30, the speed difference will cause the actuator lever 70 to rotate counterclockwise until the 15 degrees position is reached, as illustrated in FIG. 10. At this point, the roller pin 90 on one of the limit switches, i.e. the first limit switch 82, moves from the lower cam perimeter section 98 to the higher cam perimeter section 96 thereby causing the limit switch 82 to output a signal to the controller 114. This condition is represented in FIG. 13A at 150. When this occurs, the drum synchronization routine 124 outputs a command to the first hoist drum 30 to slow down and to the second hoist drum 30 to speed up to maintain a constant hook speed. This condition is represented in FIG. 13B at 152. This output command serves as a correction that keeps operation of the drums synchronous. With this correction, the actuator arm 70 returns to its horizontal position, as shown in FIG. 9.

It should be understood that the operation of lifting includes the operation of lowering as well since similar considerations and conditions apply. For example, if the front drum is operating faster than the rear drum, the link shifts the actuator arm 70 and if the shift exceeds approximately 15 degrees, the limit switch outputs a signal to the controller to slow down the front drum and/or speed up the rear drum.

With the improvement described above, disassembly of the crane 10 is facilitated. Because two shorter ropes can be used instead of a single longer rope, it is possible to wind the entire lengths of the two shorter ropes on the two hoist drums. According to this procedure, the ropes 36 and 40 are disconnected at the second ends thereof 48 and 54 from the link 52. Then, the ropes can be fully retracted from the sheaves and boom and wound onto the hoist drums.

Alternative Embodiments

According to another embodiment of the present invention, the drum synchronization routine can provide a second limit safety feature. This second limit feature prevents the actuator arm from travelling too far from its horizontal position.

Figure 11:
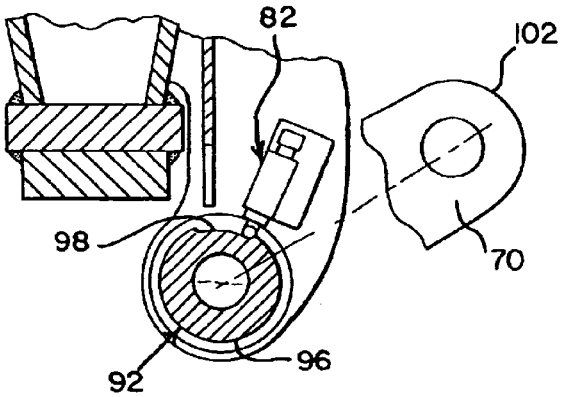
FIG. 11 is a sectional view similar to FIG. 9 showing the actuator arm in a second position.

Referring to FIG. 11, the actuator arm 70 is shown in a second position 102 in which the actuator arm 70 is shown rotated 31 degrees counterclockwise from the horizontal position of FIG. 9. When the actuator arm 70 has moved to the position shown in FIG. 11, the cam 92 has been rotated to a position at which the roller pin 90 of the limit switch 82 is at the other end of the lower perimeter 98 of the cam perimeter (relative to FIG. 10). In this position also the roller pin 90 no longer bears on the lower perimeter section 98 of the cam 92, but instead the roller pin 90 bears on the upper perimeter section 96 of the cam and, as before,.the limit switch outputs a signal indicative of the roller pin position change.

In this additional embodiment, the first limit switch 82 will also output a signal that it is on the higher perimeter section 96 if the actuator lever 70 has travelled more than 31 degrees counterclockwise from the horizontal and the second limit 84 switch will output a signal that it is on the higher perimeter section 96 if the actuator lever has travelled more than 31 degrees clockwise from the horizontal. Under these conditions, the drums are signalled to operate to effect maximum correction of the speed differential. Alternatively, the drums may be signalled to stop or shut down. Code and pseudo-code for this alternative embodiment of the drum synchronization routine using a second limit is included in Appendix B.

In the embodiments described above, it is assumed that the first and second hoist drums are fully under control of the programmable controller, however, it is also intended that an embodiment of the present invention could be incorporated in a liftcrane in which the hoist drums are under direct control of the control levers in the operator's cab. In such an arrangement, an embodiment of the present invention could be used to augment direct operator control. For example, in such an embodiment, the sensor assembly could function to trim the take up of one or the other of the hoist drums upon sensing that the take up rate of one of the ropes was exceeding that of the other of the ropes by too great a margin. However, at other times, the sensor assembly would return direct control of the hoist drums to the operator. Such an embodiment could be implemented without a CPU but use simple switches instead.

In a preferred embodiment of the present invention, the drum synchronization system is used with hoist drums and a hoist block sheave arrangement. However, it is contemplated that the synchronization system could also be used with other types of mechanical systems other than just hoist drums. Also, the synchronization system could be used with two ropes or load lines but without the hoist block sheave arrangement.

Although it is advantageous to use two ropes, for the reasons stated above, it is also contemplated that present invention could be used in a single rope arrangement. In a single rope system such as when a hoist block sheave arrangement is used, it may be. advantageous to incorporate the safety feature, described above. In a single rope system, one of the hoist drums may become inoperative or the rope may become tangled in the sheaves. This results in isolating one of the hoist drums from the load, and in such circumstances lifting of the load would be performed by only one of the hoist drums. When this happens, it results in a shifting of the rope relative to the load. This condition could be detected by an embodiment of the present invention in which a sensor associated with the rope outputs a signal to indicate that the two lengths of rope leading back from the load are shifting relative to each other. The operation of the hoist drums would be modified to balance the take up rates in a manner similar to that described above.

It is also noted that although in a preferred embodiment the sensor is mechanically attached to a link connecting the two ropes, it would also be possible to detect movement of the two ropes relative to each other by non-mechanical means. For example, shifting of the link and/or the ropes could be detected by an optical sensor, a magnetic sensor, or other types of sensors that employ other than mechanical connections, e.g. Hall effect, capacitive, etc. This detection could be performed at locations other than at the rope ends.

It is intended that the detailed description herein be regarded as illustrative rather than limiting, and that it be understood that it is the claims, including all equivalents, which are intended to define the scope of the invention.

APPENDIX A

```
/*****************************************************************************************
/*                                BLOCK UP LEVEL SYSTEM
/*                          For use with the M-1200 Ringer system
/*                        when the Ringer is set to Tandem Drum mode.
/*
/*
/*    This system is desinged to keep the hoist block level when the M-1200 Ringer is hoisting
/*  it with two drums. This compensates for differences in drum speeds and number of line wraps
/*  around either drum. The system uses two limit switches which are normally closed. In this
/*  way, an electrical fault in one or both switches can be detected if both switches respond as
/*  open.
/*
/*    When the routine begins, the following items have been established:
/*
/*          CA(0) -  This the neutral counter. If the handle command is in
/*                   neutral, this variable will increment.
/*
/*           D(0) -  Front hoist command directional flag.
/*                   If D(0) = 128, the hoist command is neutral.
/*                   If D(0) = 255, the hoist command is hoisting.
/*                   If D(0) = 0, the hoist command is lowering.
/*
/*           D(1) -  Rear hoist command directional flag. See D(0) for details.
/*
/*       PUMP(0) -   The pump command for the front hoist drum. When the routine
/*                   begins, an initial command has already been calculated.
/*
/*       PUMP(1) -   The pump command for the rear hoist drum. An initial command
/*                   has also been generated for this variable.
/*
/*           R(0) -  The hoist handle command from the cab.
/*
/*           R(5) -  The crane's operating mode, which will indicate whether or not
/*                   this routine should be used at all.
/*
/*    During the routine, the following values will be calculated:
/*
/*             BK -  The current block status.
/*                   If BK = 0, the front hoist is hoisting too
/*                        quickly or lowering too slowly.
/*                   If BK = 1, the rear hoist is hoisting too
/*                        quickly or lowering too slowly.
/*                   If BK = 2, the hoist ropes are in sync.
/*
/*             DX -  The adjustment step. This is proportional to the handle
```

APPENDIX A-continued

```
/*                          command. DX is used to calculate a factor which is applied to
/*                          the pump command, responding to the limit switch status.
/*                          ( Ref. Q0(I) )
/*
/*                I2.B1 -   The indicator bit for the front hoist. If this bit = 0, the
/*                          front hoist is hoisting too quickly or lowering too slowly.
/*
/*                I2.B2 -   The indicator bit for the rear hoist. If this bit = 0, the rear
/*                          hoist is hoisting too quickly or lowering too slowly.
/*
/*                  LBK -   The value for BK during the last program cycle.
/*
/*       MS(0) & MS(1) -    Factors used by other drum speed control routines elsewhere in
/*                          the code. These factors insure proper operation when two or
/*                          more speed control routines are operating at the same time.
/*
/*                Q0(0) -   A term calculated from DX that adjusts the front pump command in
/*                          response to the limit switch inputs, based on a funtion that
/*                          creates a smooth, controlled response.
/*
/*                Q0(1) -   A term Q0(0), that adjusts the rear pump command.
/*
/*                   Q1 -   The trim variable. This variable increases or decreases as each
/*                          of the block level switches has been tripped. It is used to
/*                          calculate a trim factor which is applied to the pump commands to
/*                          help maintain equal rope speed.
/*
/*      When the routine ends, the following variables will be set to new values:
/*
/*                MS(0) -   Will be adjusted for use later in the program.
/*
/*                MS(1) -   Also will be adjusted for later use.
/*
/*             PUMP(0) -    Will be adjusted based on wheter or not leveling was needed.
/*
/*             PUMP(1) -    Also will be adjusted bsed on leveling needs.
/*
/*****************************************************************************************
/*****************************************************************************************
/*
/*FRONT RINGER WINCH IS RIGGED TO THE RIGHT SIDE OF THE BLOCK LIMIT SWITCH I2.B1 WILL OPEN
/*IF FRONT DRUM IS HOISTING TOO FAST OR LOWERING TOO SLOW. LIMIT SWITCH I2.B2 WILL OPEN IF
/*REAR DRUM IS HOISTING TOO FAST OR LOWERING TOO SLOW.
/*
/*****************************************************************************************
IF R(5)=66
    THEN D0;
    LBK=BK; BK=2; IF NOT (I2.B2) THEN BK=1; IF NOT (I2.B1) THEN BK=0;
    IF (BK<>LBK) AND (BK=0) THEN Q1=Q1-1; IF Q1>250 THEN Q1=0;
    IF (BK<>LBK) AND (BK=1) THEN Q1=Q1+1; IF Q1>40 THEN Q1=40;
    IF CA(0)>0 THEN Q1=10; IF R(0)>128 THEN K0=R(0)-128; ELSE K0=128-R(0);
    DX=128; IF BK=1 THEN DX=128-(K0/5); IF BK=0 THEN DX=128+(K0/5); K2=DX*256;
    D0 I=0 TO 1;
        IF D(I)<>128 THEN Q0(1)=(Q0(I)-(Q0(I)/5+(K2/5);    ELSE Q0(I)=32768:
        END;
    K0=PUMP(0);
    IF K0>128
        THEN K0=128+(((K0-128)*(Q1+40))/60);
        ELSE K0=128-(((128-K0)*(80-Q1))/60);
    MS(1)=0; IF Q1<10 THEN MS (1)=(26*(10-Q1))/10; IF BK=0 THEN MS (1)=MS(1)+26;
    MS(0)=0; IF Q1>10 THEN MS (0)=(26*(Q1-10))/10; IF BK=1 THEN MS (0)=MS(0)+26;
    K0=K0+128-(Q0(0)/256); IF K0>30000 THEN K0=0; IF K0>255 THEN K0=255;
    PUMP(0)=K0; PUMP (1)=PUMP(1)-128+(Q0(1)/256);
    END;
    ELSE Q1=20;
```

APPENDIX B

PSEUDO-CODE FOR ALTERNATIVE EMBODIMENT
WITH SECOND LIMIT FEATURE.

I. Set Block Level Flag
   A. LBK = BK (Remember the previous block status)
   B. If the rope has shifted from the right side of the block to the left, set BK = 1
   C. If the rope has shifted from the left side of the block to the right, set BK = 2
   D. If the rope has seriously shifted from the right side of the block to the left, APPENDIX B-continued

PSEUDO-CODE FOR ALTERNATIVE EMBODIMENT WITH SECOND LIMIT FEATURE.

set BK = 3

E. If the rope has seriously shifted from the left side of the block to the right, set BK = 4

F. If the riope is within limits, set BK = 0.

II. Ringer Twin Drum system: Balancing sequence

A. If the ringer is in twin drum mode [ R(5) = 2 ]

1. Set R(1) = R(0), Set TM1 and TM2 = 0
[Set the pump control variables equal to each other, and reset the adjustment variables.]
2. If the block level status has changed and the rope has shifted to the left, then subtract 1 from Q1.
   a. If Q1 > 250, then set Q1 to 0
      Q1 has scrolled below 0, and has set itself at 255.
3. If the block level status has changed and the rope has shifted to the right, then add 1 to Q 1.
   a. If Q1 > 20, then set Q1 equal to 20.
4. Adjust TM1 and TM2.
   a. If Q1 > 10, then set TM1 = Q1 − 10.
   b. If Q1 < 10, then set TM2 = 10 − Q1.

At this point it should be noted that, between TM1 and TM2, only one of them has an actual value. The other is equal to 0, and will remain so for the rest of the calculations. This way, the crane only trims in one direction.

5. If R(0) > 146 {Crane is hoisting . . . }
   a. Adjust TM1 and TM2
      i. TM1 = ( TM1 X ( R(0) − 146 ) ) / 66
      ii. TM2 = ( TM2 X ( R(0) − 146 ) ) / 66
   b. If the rope shifted to the left, then TM1 = R(0) − 146
   c. If the rope shifted to the right, then TM2 = R(0) − 146
6. If R(0) < 110 {Crane is lowering . . . }
   a. Adjust TM1 and TM2
      i. TM1 = ( TM1 X ( 110 = R(0) ) ) / 66
      ii. TM2 = ( TM2 X ( 110 = R(0) ) ) / 66
   b. If the rope shifted to the left, then TM1 = 110 − R(0)
   c. If the rope shifted to the right, then TM2 = 110 − R(0)
7. Bracket TM1 and TM2
   a. If TM1 > 10, then set TM1 = 10
   b. If TM2 > 10, then set TM2 = 10
8. If TM1 + R(0) exceeds maximum pump command, adjust TM1 to twice the exceeding amount.
   a. If ( R(0) + TM1 ) > 212, then TM1 = TM1 + ( ( R(0) + TM1 ) − 212 )
   b. If ( R(0) − TM1 ) < 44, then TM1 = TM1 + ( 44 − ( R(0) − TM1 ) )
9. If TM2 + R(0) exceeds maximum pump command, adjust TM1 to twice the exceeding amount.
   a. If ( R(0) + TM2 ) > 212, then TM2 = TM2 + ( ( R(0) + TM2 ) − 212 )
   b. If ( R(0) − TM2 ) < 44, then TM2 = TM2 + ( 44 − ( R(0) − TM2 ) )
10. Reset the command values for the control handles and bracket them.
   a. Adjust and bracket the front drum control.
      R(0) = R(0) − TM2 + TM1
      i. If R(0) > 212, set R(0) = 212
      ii. If R(0) < 44, set R(0) = 44
   b. Adjust and bracket the rear drum control.
      R(1) = R(1) − TM1 + TM2
      i. If R(1) > 212, set R(1) = 212
      ii. If R(1) < 44, set R(1) = 44

B. If R(5) <> 2, set Q1 = 10

Variable List:

| | | |
|---|---|---|
| BK: Block level variable - | 0/ | Block is level |
| | 1/ | Rope has shifted from the left side to the right. |
| | 2/ | Rope has shifted from the right side to the left. |
| | 3/ | Rope has seriously |
| | 4/ | shifted from the left to |

12.B1: Digital Input - Rear drum side is high

12.B2: Digital Input - Front drum side is high

| | |
|---|---|
| LBK | Lost Block level variable value |
| Q1 | Hoist pump adjustment intensity |
| TM1 | Hoist pump trim command: Rope shifted from the right to the left. |
| TM2 | Hoist pump trim command: Rope shifted from the left to the right. |
| R(0) | Front drum handle command |
| R(1) | Rear drum pump control |
| R(5) | Crane mode- When R(5) = 2, then the crane is in the twin drum hoist mode. |

CODE FOR ALTERNATIVE EMBODIMENT
WITH SECOND LIMIT FEATURE

```
*****************************************************************************************
        FRONT RINGER WINCH IS RIGGED TO THE RIGHT SIDE OF THE BLOCK. LIMIT SWITCH I2.B2 WILL OPEN
        IF FRONT DRUM IS HOISTING TOO FAST OR LOWERING TOO SLOW. LIMIT SWITCH I2.B1 WILL OPEN IF
        REAR DRUM IS HOISTING TOO FAST OR LOWERING TOO SLOW. R(0)=RH CONTROL HANDLE. R(1)=LH
        CONTROL HANDLE.
*****************************************************************************************
                                                                        /*SET BLOCK LEVEL FLAG*/
LBK=BK;
IF (NOT(I2.B1)) AND I2.B2 THEN BK=1; IF (NOT(I2.B2)) AND I2.B1 THEN BK=2;
IF (NOT(I2.B1)) AND (NOT(I2.B2)) AND (LBK=1) THEN BK=3;
IF (NOT(I2.B1)) AND (NOT(I2.B2)) AND (LBK=2) THEN BK=4;
IF I2.B1 AND I2.B2 THEN BK=0;
                                                                        /*RINGER TANDEM*/
IF R(5)=2
        THEN D0:
        R(1)=R(0); TM1, TM2=0;
        IF (BK<>LBK) and BK-2) THEN Q1−1; IF Q1>250 TEN Q1=0;
        IF (BK<>LBK) and (BK-1) THEN Q1=Q1+1; IF Q1>20 THEN Q1=20;
        IF Q1>10 THEN TM1=Q1−10; IF Q1<10 THEN TM2=10−Q1;
        IF R(0)>146
                THEN D0;
                TM1=(TM1*(R(0)−146))/66; TM2=(TM2*(R(0)−146))/66;
                IF (BK=1) OR (BK=3) THEN TM1=R(0)−146;
                IF (BK=2) OR (BK=4) THEN TM2=R(0)−146;
                END;
        IF R(0)<110
                THEN D0;
                TM1=(TM1*(110−R(0)))/66; TM2=(TM2*(R(0)−146))/66;
                IF (BK=1) OR (BK=3) THEN TM1=110-R(0);
                IF (BK=2) OR (BK=4) THEN TM2=110-R(0);
                END;
        IF TM1>10 THEN TM1=10; IF TM2>10 THEN TM2=10;
        IF (R(0)+TM1)>212 THEN TM1=TM1+((R(0)+TM1)−212);
        IF (R(0)−TM1)<44 THEN TM1=TM1+(44−(R(0)−TM1));
        R(0)=R(0)−TM2+TM1; IF R(0)>212 THEN R(0)=212; IF R(0)<44 THEN R(0)=44;
        R(1)=R(1)−TM1+TM2; IF R(1)>212 THEN R(1)=212; IF R(1)<44 THEN R(1)=44;
        END;
        ELSE Q1=10
```

We claim:

1. A method of operating a liftcrane that has a boom, first and second hoisting mechanisms and a first rope and a second rope, comprising the steps of:

a) winding a first end of said first rope on the first hoisting mechanism;

b) winding a first end of said second rope on the second hoisting mechanism;

c) coupling a second end of said first rope to a second end of said second rope in a manner that transfers tension equally between said ropes;

d) operating the liftcrane to lift a load suspended from the boom and coupled to said first and second ropes by combined action of the first hoisting mechanism and the second hoisting mechanism wherein both the first and second hoisting mechanisms each lift a substantially equal part of the load and the first and second hoisting mechanisms together lift the entire load;

e) sensing the relative amount by which said first ends of said ropes are being taken up and sending a signal indicative of said sensing to a processor having a synchronization routine; and f) adjusting operation of at least one of said hoisting mechanisms based upon said routine operating on said signal from said sensing.

2. The method of claim 1 further comprising the step of:

suspending operation of said first and second hoisting mechanisms upon the condition that the amount sensed exceeds a threshold.

3. The method of claim 2 in which said first and second ropes are joined together at a link, and in which the sensing step further comprises:

sensing movement of said link.

4. A method of operating a liftcrane that has first and second hoisting mechanisms, a hoist block sheave arrangement having an upper block half and a lower block half, and a first rope and a second rope, comprising the steps of:

a) winding a first end of said first rope on the first hoisting mechanism;

b) winding a first end of said second rope on the second hoisting mechanism;

c) reeving the ropes between the upper and lower block halves;

d) lifting a load suspended from the lower block half by combined action of the first hoisting mechanism and the second hoisting mechanism wherein both the first and second hoisting mechanisms each lift a substantially equal part of the load and the first and second hoisting mechanisms together lift the entire load;

e) sensing the relative amount by which said ropes are being taken up and sending a signal indicative of said sensing to a processor having a synchronization routine; and f) adjusting operation of at least one of said hoisting mechanisms based upon an output from the processor synchronization routine operating on said signal from said sensing.

5. The method of claim 4 further comprising the step of:

suspending operation of said first and second hoisting mechanisms upon the condition that the amount sensed exceeds a threshold.

6. The method of claim 5 in which said first and second ropes are joined together at a link, and in which the sensing step further comprises:

sensing movement of said link.

7. A method of operating a liftcrane that has first and second hoisting mechanisms and a rope having a first section of rope with a first end wound on the first hoisting mechanism and a second section of rope with a first end wound on the second hoisting mechanism, comprising the steps of:

a) lifting a load coupled to the first and second sections of rope by combined action of the first hoisting mechanism and the second hoisting mechanism wherein both the first and second hoisting mechanisms each lift a substantially equal part of the load and the first and second hoisting mechanisms together lift the entire load;

b) sensing the relative amount by which said sections of said rope are being taken up; and c) using a processor having a routine to adjust operation of at least one of said hoisting mechanisms based upon said sensing.

8. The method of claim 7 which said rope is comprised of a first rope and a second separate rope.

9. The method of claim 8 wherein said sensing comprises sending a signal to the processor from a sensor sensing movement of a link between the first and second ropes.

10. The method of claim 7 wherein the first and second sections are part of one continuous rope.

11. The method of claim 10 wherein the load is coupled to a middle portion of said rope connecting the first and second sections of rope.

12. The method of claim 7 in which said sensing comprises detecting movement of the first and second sections of rope.

13. The method of claim 12 in which the rope section movement is detected by a method selected from the group consisting of optical sensors, magnetic sensors, Hall effect sensors and capacitive sensors.

14. The method of claim 12 in which the detection of movement is performed at a location other than at the rope section ends.

15. The method of claim 12 wherein the processor is part of a programmable controller and the first and second hoisting mechanisms comprise first and second hoist drums controlled by the programmable controller.

16. The method of claim 12 wherein the rope sections are reeved through hoist block sheaves and the load is lifted by the hoist block.

17. The method of claim 7 wherein the processor adjustment maintains a relative uniform rate at which the first and second sections of rope are taken up.

18. The method of claim 7 wherein a sensor detects a relative difference in rates at which the first and second sections are taken up and outputs a signal indicative of the difference.

19. The method of claim 7 wherein the first and second sections of rope are coupled to the load so as to allow tension to be transferred equally between the first and second rope sections.

20. The method of claim 7 wherein the routine provides an output to synchronize the operation of first and second hoisting mechanisms.

* * * * *

UNITED STATES PATENT AND TRADEMARK OFFICE

CERTIFICATE OF CORRECTION

PATENT NO. : 6,758,356 B1
APPLICATION NO. : 08/748986
DATED : July 6, 2004
INVENTOR(S) : Arthur G. Zuehlke et al.

It is certified that error appears in the above-identified patent and that said Letters Patent is hereby corrected as shown below:

On the Title Page

Left column, item (60), replace lines 1 through 6, under "Related U.S. Application Data", with --This application is a division of application No. 08/210,988, filed March 18, 1994, now U.S. Patent No. 5,579,931.--.

Signed and Sealed this
Twenty-fourth Day of September, 2013

Teresa Stanek Rea
*Deputy Director of the United States Patent and Trademark Office*